US007568417B1

(12) United States Patent
Lee

(10) Patent No.: US 7,568,417 B1
(45) Date of Patent: Aug. 4, 2009

(54) DEVICE AND METHOD FOR PULLING BULLETS FROM CARTRIDGES

(76) Inventor: Richard J. Lee, 3416 Kettle Moraine Rd., Hartford, WI (US) 53027

( * ) Notice: Subject to any disclaimer, the term of this patent is extended or adjusted under 35 U.S.C. 154(b) by 0 days.

(21) Appl. No.: 12/214,849

(22) Filed: Jun. 23, 2008

(51) Int. Cl.
*F42B 33/06* (2006.01)

(52) U.S. Cl. ..... 86/49

(58) Field of Classification Search ..... 86/49, 86/24, 50; 81/3.05; 29/700; 279/102, 103
See application file for complete search history.

(56) References Cited

U.S. PATENT DOCUMENTS

| | | | | | |
|---|---|---|---|---|---|
| 2,468,946 | A * | 5/1949 | Sherman | 279/48 |
| 2,484,027 | A * | 10/1949 | Haffey | 279/16 |
| 2,552,772 | A * | 5/1951 | Fisig | 86/49 |
| 2,567,299 | A * | 9/1951 | Pastell | 279/102 |
| 2,828,663 | A * | 4/1958 | Andrade | 86/49 |
| 2,869,883 | A * | 1/1959 | Dunbar | 279/102 |
| 2,970,508 | A * | 2/1961 | Wicks | 86/49 |
| 3,123,369 | A * | 3/1964 | Jacobsen | 86/49 |
| 3,174,389 | A * | 3/1965 | Davis | 86/23 |
| 3,898,908 | A * | 8/1975 | Isenhower et al. | 86/49 |
| 4,005,630 | A * | 2/1977 | Patrick | 86/49 |
| 5,079,986 | A * | 1/1992 | Lee | 86/39 |
| 5,146,043 | A * | 9/1992 | Means et al. | 86/49 |
| 5,333,367 | A * | 8/1994 | Ashbrook | 29/275 |
| 5,490,313 | A * | 2/1996 | Ashbrook | 29/275 |

* cited by examiner

*Primary Examiner*—Troy Chambers
*Assistant Examiner*—Jonathan C Weber
(74) *Attorney, Agent, or Firm*—Philip J. Lee

(57) ABSTRACT

A device for use with an ammunition reloading press, the device uses a "C" shaped split ring that is captured within a chamber with a slightly tapered frustaconical wall into the smaller end of which the bullet portion of an ammunition round can be inserted to a point where the bullet enters the C ring with a friction fit and subsequent withdrawal of the ammunition cartridge by operation of the press draws the ring into the increasingly narrow wall, decreasing the diameter of the ring and forcing a tighter grip on the bullet, which is then separated from the cartridge by further withdrawal and is removable from the device through an opening at the larger end of the chamber.

14 Claims, 3 Drawing Sheets

DEVICE AND METHOD FOR PULLING BULLETS FROM CARTRIDGES

BACKGROUND OF THE INVENTION

A. Field of Invention

The present invention relates generally to devices used in ammunition loading or reloading and more particularly to a new and improved device and method for pulling or removing bullets from ammunition cartridges.

B. Description of Related Art

In the loading or reloading of ammunition cartridges, a bullet is inserted into a cartridge and secured therein, generally by crimping the cartridge neck to the shank of the bullet securely enough that the bullet will not inadvertently separate from the cartridge, but will be separated by the explosive force of the charge when fired. It is occasionally desirable to separate a bullet from a cartridge into which the bullet has been inserted and secured, to salvage the components or prepare for reloading. Since the assembled ammunition represents a live round it must be handled with care to avoid accidents. Past tools for this purpose such as those shown in U.S. Pat. No. 3,174,389 to Davis or U.S. Pat. No. 2,970,508 to Wicks or U.S. Pat. No. 4,005,630 to Patrick use collet type clamps that forcefully seize the bullet with a multiplicity of jaws and may leave scratches or otherwise damage the bullet, preventing or compromising reuse. Collet type devices are relatively complex and expensive to manufacture. Simpler devices are available but are similarly damaging to bullets, the damage appearing to be caused by the impact of the clamping mechanism to the bullet.

It would therefore be desirable to provide a device that is inexpensive to manufacture and capable of safely removing a bullet from the case in which it has been installed without damage to the bullet.

SUMMARY OF THE INVENTION

The device of the present invention constitutes a tool for use with a typical ammunition reloading press having at least a tool mount and ram arm forcibly moveable towards and away from a mounted tool. The tool of the present invention includes a "C" shaped ring consisting of a flexible substance formed as an incomplete annulus that is captured within a chamber with slightly tapered walls. The chamber wall is annular and tapered to present an inverted frustaconical surface so that the chamber has a larger internal diameter at its upper end. A tool body supports the C ring and chamber and is adapted to be mounted on a typical reloading press. The tool body has a central bore into which an ammunition cartridge can be at least partially inserted to a point where the bullet shank, close to but not within the cartridge, enters the C ring, which is then located in the chamber. Below the conical chamber, the central bore narrows to a neck sized to allow passage of the bullet and a portion of the case neck. Above the conical chamber, a cap partially encloses the chamber, leaving a central opening through which the bullet may pass. The C ring is formed slightly smaller than the greatest diameter portion of the bullet to be removed with a shape that evenly contacts the surface of the bullet when the bullet is engaged by the C ring. The outer diameter of the C ring, when relaxed, is larger than the inside diameter of the cap opening and the inside diameter of the central bore neck so that the C ring is captured within the chamber when assembled. The entry of the nose of the bullet into the C ring initially forces the C ring upward until the C ring engages a shoulder that prevents further upward movement and then the continued upward movement of the bullet forces the C ring onto the bullet as the C ring flexes radially outwardly, increasing the C ring diameter to accommodate the bullet. When the C ring has been expanded by the entry of the bullet into the center of the ring, the outside diameter of the ring is greater than the inside diameter of the lower, narrower end of the frustaconical surface and smaller than the inside diameter of the upper, broader end of the frustaconical surface. The ram arm is operated upwardly until the C ring is adjacent to but not around the cartridge neck. A subsequent downward operation of the press pulls the entire round downward, pulling the C ring downward within the conical chamber. As the C ring descends, the reduced diameter of the chamber inner wall forces the C ring to reduce in diameter and grip the bullet with increasing force. When the C ring grips the bullet with sufficient force to retain the bullet despite continued downward movement of the ram arm and attached cartridge, the bullet is forcibly separated from the cartridge. Since the bullet separates when the retentive force of the C ring reaches the minimum required to pull the bullet from the cartridge, no more force is applied to the bullet than necessary. The minimum force applied to the bullet and the even circumferential application of that force reduces the damage to the bullet surface. The bullet is then removed from the chamber, by being forced up and out by another bullet repeating the process. A container may be secured such that the removed bullets are collected as they exit the tool. As the separated bullet is removed upwardly, past the chamber shoulder, the C ring again engages the chamber shoulder and is retained within the chamber.

The principle aim of the present invention is to provide a new and improved method and device means for separating bullets from ammunition rounds that meets the foregoing requirements and is convenient and safe to load and operate as well as economical to manufacture and use.

Other objects and advantages of the invention will become apparent from the Description of the Preferred Embodiments and the Drawings and will be in part pointed out in more detail hereinafter.

The invention consists in the features of construction, combination of elements and arrangement of parts exemplified in the construction hereinafter described and the scope of the invention will be indicated in the appended claims.

DESCRIPTION OF THE PREFERRED EMBODIMENT(S)

Figure 1:
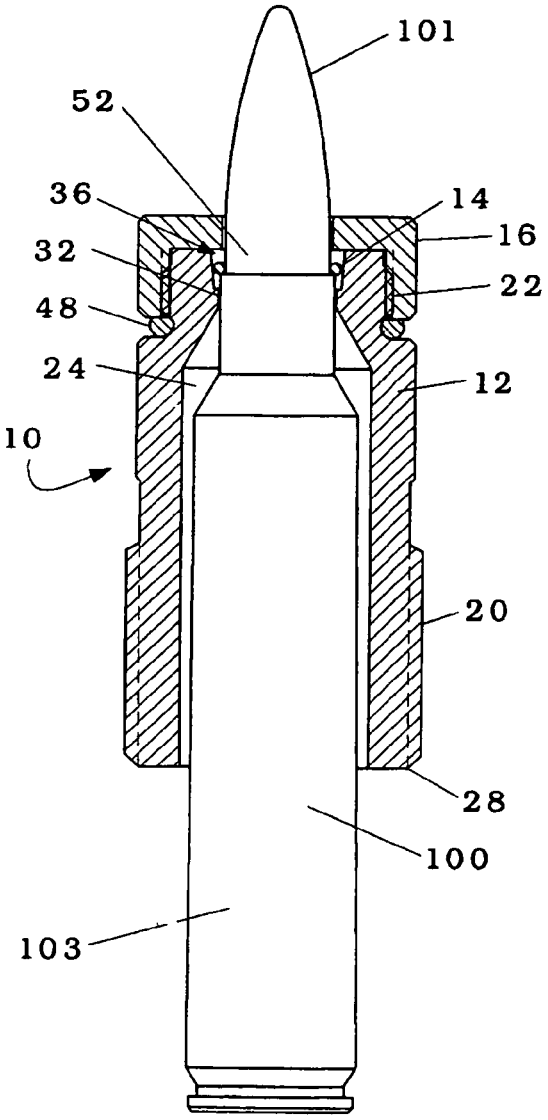
FIG. 1 is a side cross sectional view of a bullet pulling device of the present invention shown with an ammunition round inserted therein.
Figure 2:
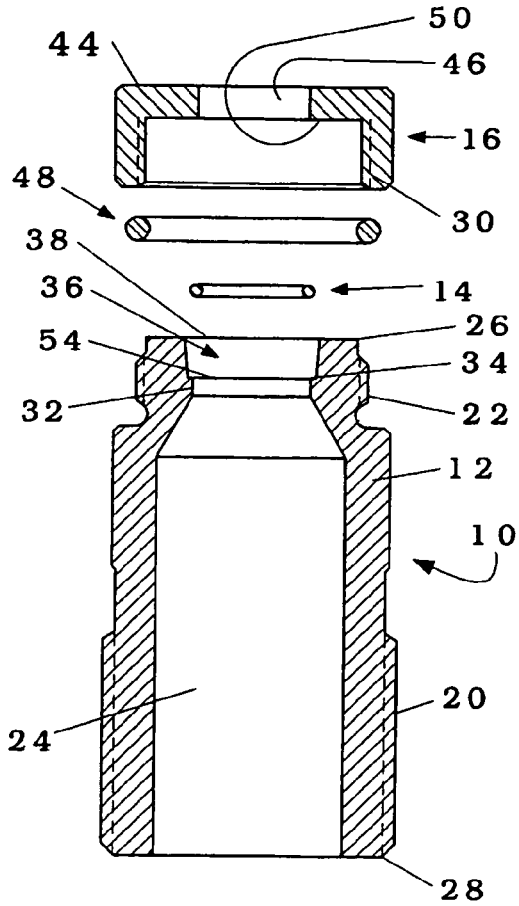
FIG. 2 is a side cross sectional view of the components of an unassembled bullet pulling device of the present invention.
Figure 3A:
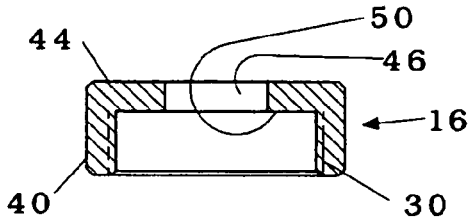
FIG. 3A is a side cross sectional view taken along line 3A-3A in FIG. 3B.
Figure 4:
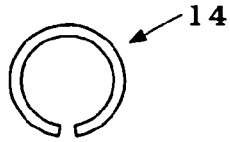
FIG. 4 is a top view of a ring member of an unassembled bullet pulling device in accord with the present invention.
Figure 3B:
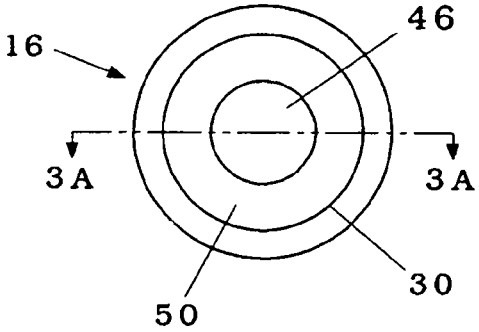
FIG. 3B is a bottom view of a cap member of a bullet pulling device of the present invention.
Figure 5:
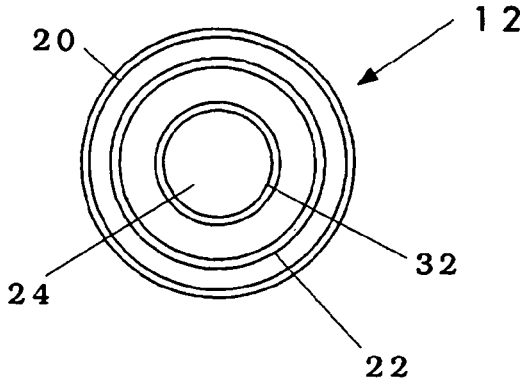
FIG. 5 is a top view of a body member of an unassembled bullet pulling device in accord with the present invention.
Figure 6:
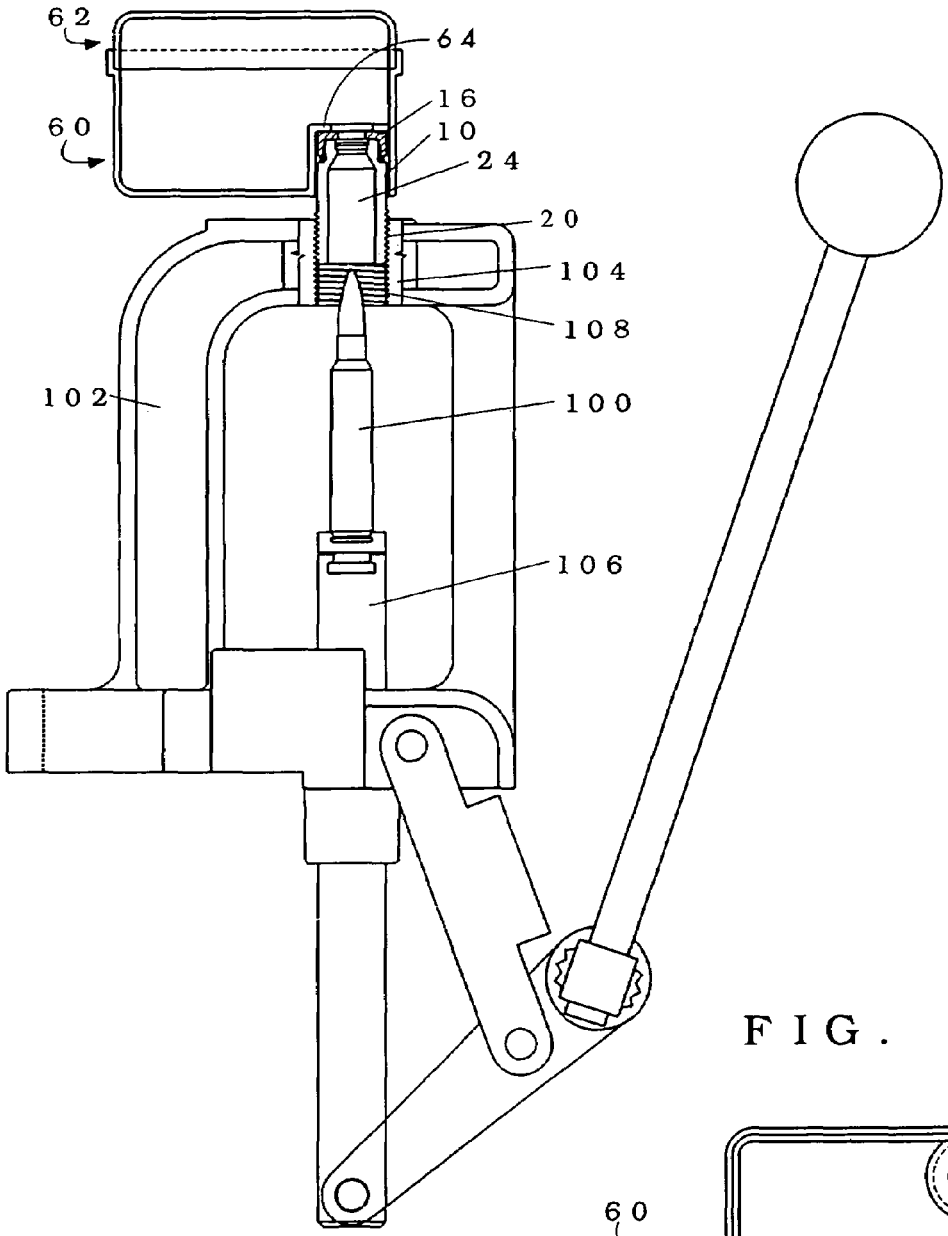
FIG. 6 is a side view with cutout sections of the assembled bullet pulling device in accord with the present invention in stalled in a typical ammunition reloading press.
Figure 7:
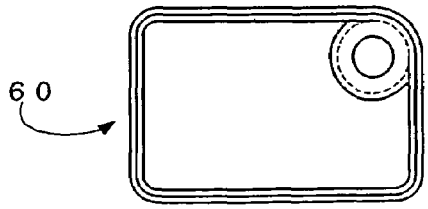
FIG. 7 is a top view of a container for collecting separated bullets in accord with the present invention.

With reference to the Drawings wherein like numerals represent like parts throughout the Figures, a device of the present invention for separation of a bullet from the cartridge with which the bullet has previously been joined in the assembly of an ammunition cartridge is generally designated by numeral 10 in FIGS. 1, 2, and 6. Conventional or typical ammunition cartridges are shown in some of the drawings and designated by the numeral 100, comprising a bullet 101 and a cartridge case 103, the bullet 101 being installed in the neck of case 103, and a conventional ammunition reloading press is designated by the numeral 102.

Device 10 consists of a body member 12, a "C" ring 14, and a cap member 16 and is intended for use with reloading press 102 having a tool mount 104 and a ram arm 106 forcibly moveable towards and away from a mounted device 10 as shown in FIG. 6. Since the usual orientation of a reloading press uses an upward motion to advance the ram arm 106 toward a tool, that orientation is used in this application to describe the components and arrangement of device 10. Accordingly, "upper", "top" or "above", or the like assume that the direction of the ram arm 106 travels toward device 10 is upward, and this assumption in no way limits the orientation in which the device 10 can be used.

Body member 12 is generally cylindrical with an upper end 26 and a lower end 28 with a central bore 24 extending from between the upper and lower ends 26 and 28. Body member 12 is formed with external threads at both upper and lower ends 26 and 28, the lower end threads 20 corresponding to female threads 108 found on the press 102 to allow secure mounting of device 10 to the press 102 and the upper threads 22 corresponding to female threads 30 formed on a cap member 16. Central bore 24 is formed generally with axial rotational symmetry and comprises an neck section 32 with a reduced inside diameter that is large enough to allow passage of the bullet and the cartridge neck to enter the central bore 24 until the ring 14 abuts the shoulder 50 of cap 16. The interior of bore 24 below body member neck section 32 is tapered to guide a bullet 101 toward the neck section 32 without scratching bullet 101. Above neck section 32, the inside diameter of bore 24 increases. In the illustrated preferred embodiment, an annular, upwardly facing shoulder 34 is formed and above shoulder 34, bore 24 gradually increases in diameter. The gradual increase in inside diameter of bore 24 forms an inverted frustaconical surface 36, having a larger internal diameter at its upper end 38 and a smaller diameter at its lower end 54. It will be anticipated that the frustaconical surface 36 may extend to the bore neck section without forming shoulder 34.

Cap member 16 comprises a downward extending flange 40 with an inside wall forming female threads 30. Cap member 16 has a generally flat top surface 44 with a central opening 46 large enough to allow a bullet to be pulled to pass through. Cap member opening 46 is coaxial with body member central bore 24 including neck section 32 and is slightly larger than the bullet diameter and of a smaller inside diameter than the inside diameter of the frustaconical surface upper end 38. Cap member 16 is assembled by engagement of cap member threads 30 with body member upper threads 22 and the underside of cap member top 44 forms a downward facing annular shoulder 50 that is wider than upward facing shoulder 34. Assembling cap member 16 with body member 12 forms a chamber 52 with openings at both ends with a frustaconical inside surface 36 extending from shoulder 34 formed in body member 12 to downward facing shoulder 50 formed by cap member 16. A standard elastomer "O" ring 48 assembled between cap 16 and body member 12 provides friction to keep cap 16 from loosening from body member 12.

"C" ring 14 is a split ring with a generally annular shape forming a nearly complete arc, shaped to evenly engage most of the circumference of a bullet 101 inserted therein and made of a suitably flexible material to allow a bullet 101 to pass through. The outside diameter of ring 14, when in a relaxed state, is slightly less than the inside diameter of the frustaconical inside surface upper end 38 and slightly greater than the inside diameter of the central bore neck section 32. The outside diameter of ring 14 is greater than the inside diameter of cap member top opening 46. When device 10 is assembled, "C" shaped ring 14 is placed within chamber 52 and cap 16 is secured to body member upper end 26 by engagement of body member upper male threads 22 by cap member female threads 30, and ring 14 is captured within chamber 52 of the assembled device 10, between shoulder 34 at neck section 32 and shoulder 50 formed by cap member 16. The inside diameter of ring 14 is selected to be approximately a friction fit on the bullet to be pulled. The central bore, frustaconical wall, chamber openings and the ring are all coaxially aligned in the assembled device.

The method of the present invention comprises forming a device 10 with central bore neck section 32, cap opening 46 and C ring 14 of an appropriate size for the diameter of the bullets 101 to be pulled, installation of device 10 in a reloading press 102 by means of engagement of body member lower threads 20 with tool mount threads 108, securing an ammunition round 100 to be disassembled on press ram 106 such that round 100 will pass into central bore 24 and the bullet 101 and only the end portion of the neck of cartridge case 103 will pass through neck section 32 and only the bullet 101 can enter into ring 14, within chamber 52. The entry of the bullet 101 into ring 14 and the interference fit of the bullet 101 in ring 14 initially forces ring 14 upward until ring 14 engages shoulder 50, which prevents further upward movement by ring 14. The continued upward movement of the bullet forces ring 14 to flex radially outwardly to enlarge the inside diameter of ring 14 to fit around the portion of bullet 101 with the greatest circumference. Press ram arm 106 is operated upwardly until ring 14 has been forced along the bullet until adjacent to the cartridge. A subsequent downward operation of press ram arm 106 initially pulls the entire cartridge 100 downward, pulling ring 14 downward within conical chamber 52 and as ring 14 is pulled downward, the contact between the gradually reducing diameter of the frustaconical surface of inner wall 36 forces ring 14 to reduce in diameter and grip the bullet 101 with increasing force. When the retentive force of the gradually reducing diameter of ring 14 gripping the bullet 101 exceeds the retentive force provided by the cartridge case 103, continued downward movement of the ram arm 106 and attached cartridge case 103 causes separation of bullet 101 from the cartridge case 103. The bullet 101 may then be removed from the device chamber 52, through the top opening 46, either by being pulled or forced up and out by another bullet repeating the process. As the separated bullet 101 with ring 14 still attached is forced upwardly whether by a subsequent bullet or otherwise, ring 14 again engages the cap member shoulder 50 and is removed from bullet 101 and retained within chamber 52. The pulled bullet 101 may then be removed by hand or allowed to drop into an appropriately positioned collection means, such as the illustrated container 60, with a removable lid 62 recessed socket 64 for removably securing the container 60 to the top of device 10.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and the scope of the present invention. It is specifically anticipated a variety of materials could be suitable for use in constructing device 10 without departing from the spirit of this invention.

It will be further anticipated that device 10 can and will be dimensioned and configured in a variety of sizes to accommodate a variety of ammunition round sizes, being formed to function with a specific type and size of ammunition. Some adjustment of the vertical position of device 10 relative to press 102 may be made by adjusting the threaded engagement of lower body member threads 20 with press 102, to adjust for variation in cartridge length, in which case, use of a threaded lock ring (not shown) may be beneficial to secure the vertical desired position.

What is claimed is:

1. A device for separation of the bullet from an ammunition cartridge and for use with a reloading press having means for mounting the device and press ram means for forcibly advancing an ammunition cartridge toward and withdrawing away from the device, the device comprising a chamber having a ring within the chamber, the chamber having an internal frustaconical wall having a larger diameter end and a smaller diameter end, and openings at each end wherein the chamber openings are slightly larger than the bullet and smaller than the ring, allowing passage of the bullet into and through the chamber and retaining the ring within the chamber, the ring having an inside diameter slightly smaller than the bullet and being of sufficient flexibility to receive the bullet within the center of the ring, with an outside diameter that is, when the ring is expanded by insertion of a bullet within the center of the ring, larger than the smaller diameter end of the frustaconical wall and smaller than the larger diameter end of the frustaconical wall.

2. The device of claim 1, wherein the ring is split, forming an incomplete annulus.

3. The device of claim 1, wherein the central bore, frustaconical wall and chamber openings are coaxially aligned.

4. The device of claim 3, further comprising an externally threaded body for mounting the device on the press.

5. The device of claim 4, wherein the ring is shaped to contact most of the bullet circumference when the bullet is inserted into the ring.

6. The device of claim 5 wherein the chamber is formed by the device body and further comprising a cap member having the chamber larger end opening formed therein and being securable to the device body to across the chamber larger end.

7. The device of claim 6 wherein the cap member and device body further comprise screw threads to removably secure the cap member to the device body.

8. A method of removing a bullet from an ammunition cartridge using a device mounted on an ammunition reloading press having means for mounting the device and press ram means for forcibly advancing an ammunition cartridge toward and withdrawing away from the device, the method comprising forming a device body comprising a chamber having a frustaconical wall having a larger diameter end and a smaller diameter end and openings at each end, forming a ring with sufficient flexibility to receive the bullet within the center of the ring and having an inside diameter, when relaxed, slightly smaller than the bullet and an outside diameter, when a bullet is inserted into the ring, smaller than the larger diameter end of the frustaconical wall and larger than the smaller end of the frustaconical wall and larger than the chamber opening at the larger diameter end, assembling the device with the ring within the device body chamber, mounting the device on the press, securing a cartridge to the press ram, operating the press to advance the bullet into the device and into the ring, and operating the press to withdraw the cartridge from the device.

9. The method of claim 8, wherein the step of forming the ring further comprises forming the ring with a split section.

10. The method of claim 9, wherein the step of forming the ring further comprises forming the ring to have an inside diameter, when relaxed, slightly smaller than the bullet.

11. The method of claim 10, wherein the step of forming the ring further comprises forming the ring to have an outside diameter, when relaxed that is larger than the chamber openings.

12. The method of claim 11, further comprising the steps of removing the ring from the separated bullet and retaining the ring within the chamber by forcing the bullet through the larger end chamber opening.

13. The method of claim 12, wherein the steps of removing the ring from the separated bullet and retaining the ring within the chamber are performed by advancing a second bullet into the chamber through the smaller end chamber opening.

14. The method of claim 13, further comprising the step of providing a means for removing and collecting bullets that have been separated from cartridges.

* * * * *